US006032436A

United States Patent [19]

Hart et al.

[11] Patent Number: 6,032,436

[45] Date of Patent: Mar. 7, 2000

[54] WRAPPING APPARATUS AND METHOD

[75] Inventors: Gary Hart, Fombell; James McKenna, Ellwood City, both of Pa.

[73] Assignee: Herr-Voss Corporation, Callery, Pa.

[21] Appl. No.: 09/015,470

[22] Filed: Jan. 29, 1998

[51] Int. Cl.[7] ..... B65B 27/10

[52] U.S. Cl. ..... 53/399; 53/588

[58] Field of Search ..... 53/399, 588, 591, 53/210, 589, 148, 236

[56] References Cited

U.S. PATENT DOCUMENTS

| | | | |
|---|---|---|---|
| 3,324,789 | 6/1967 | Buettner . | |
| 4,050,220 | 9/1977 | Lancaster et al. . | |
| 4,079,565 | 3/1978 | Lancaster, III et al. . | |
| 4,549,388 | 10/1985 | Lancaster . | |
| 4,587,791 | 5/1986 | Brouse et al. | 53/589 X |
| 4,593,518 | 6/1986 | Lancaster . | |
| 5,107,657 | 4/1992 | Diehl et al. | 53/588 X |
| 5,211,350 | 5/1993 | Ritter et al. | 53/589 X |
| 5,216,871 | 6/1993 | Hannen . | |
| 5,282,347 | 2/1994 | Cleine et al. . | |
| 5,755,083 | 5/1998 | Cleine | 53/588 |

FOREIGN PATENT DOCUMENTS

| | | | |
|---|---|---|---|
| 3624445 | 2/1988 | Germany | 53/588 |

*Primary Examiner*—Linda Johnson

*Attorney, Agent, or Firm*—Kirkpatrick & Lockhart LLP

[57] ABSTRACT

The present invention discloses a wrapping apparatus for wrapping a load of material comprising a traversing endless loop track, a wrapping medium dispensing shuttle able to navigate about the entire length of the track, and a plurality of individual retractable support stands aligned to form a retractable support table. The track is oriented to encircle the load of material while traversing the length of the load. The support stands are able to be individually biased between a raised and lowered position such that a gap between the support stand and the load is created allowing passage of the track therethrough. In operation, runner members are placed on the support stands and a load of material is placed atop the runners. The track is traversed along the length of the load and the shuttle is made to travel about the circumference of the track while dispensing wrapping medium therefrom onto the surface of the load of material. The support stands and previously loaded runners are individually sequentially lowered to allow passage of the track and application of the wrapping medium to the complete surface of the load along its length without encapsulating the runners. The runners are then temporarily affixed to the bottom of the load. The wrapping medium is twisted into a rope and the track is traversed back across the length of the load, with each support stand individually lowering to allow the track to pass and to allow the runners to be roped into place.

30 Claims, 14 Drawing Sheets

WRAPPING APPARATUS AND METHOD

BACKGROUND OF THE INVENTION

1. Field of the Invention

The present invention relates to the wrapping, packaging and palletizing of goods. More particularly, the present invention relates to an automated apparatus for wrapping goods in the nature of relatively large three-dimensional items in an envelope of protective packaging and for securing support members thereto.

2. Description of the Invention Background

The efficient and effective protection and transportation of both packaged and unpackaged goods has long been one of the more vexing problems facing manufacturers and shippers of those goods. In a variety of cases, enclosing the goods in a web of stretch wrap plastic and placing the goods on a wooden pallet has proven to be an effective method of protecting the goods during shipping and handling. In the current automated palletizing devices, the goods are place on a pallet and then the pallet and the goods are run through a wrapping apparatus wherein the pallet and goods are wrapped together within a single web of plastic. The web of plastic forms a moisture barrier around the goods, while the pallet provides for simplified transportation by way of a forklift or other material handling device.

However, current automated methods of stretch wrapping and palletizing do not work well for all types of materials. Thus, some types of materials require manual wrapping and palletizing. In addition to yielding inconsistent results, manual wrapping and palletizing of goods is generally time consuming and expensive. The cost, time and results often combine to eliminate manual wrapping and palletizing as an option for many producers of goods. In particular, sheet metal producers are relegated to stacking the bare sheet metal directly onto a pallet and then strapping the sheet metal to the pallet using a variety of metal bands. Clearly, such a method provides little protection to the product against damage and deterioration during shipping and storage. As a result, manufacturers of sheet metal and other products similarly not suited to wrapping and palletizing using existing automated wrapping and palletizing machinery require an alternative means of preparing their goods for transport that will provide a cost effective means of protecting their goods during shipping and handling.

However, simply modifying an existing automated wrapping and palletizing machine to accommodate stacks of sheet metal invites inefficiency. Existing methods of palletizing and wrapping suffer from several key inefficiencies. The utility of such packaging is lost after shipping and handling and it is typically discarded when the goods reach their ultimate destination. It is thus desirable that such protective wrapping be inexpensive and recyclable or easily disposable. In addition, the traditional pallet too, is normally disposed of or recycled and reused when the goods are ultimately used for their intended purpose. Therefore, it also desirable that both the pallet or platform and the plastic web be relatively inexpensive and recyclable or easily disposed of. Unfortunately, addressing the issues of cost and disposability generally requires a reduction in the overall strength and resiliency of the protection provided over extended periods of time.

In seeking to deal with these concerns, the existing art has embraced a palletizing method that includes placing the load or material to be shipped on a disposable wooden pallet and wrapping the load and pallet together in a single envelope of wrapping medium. Such wrapping medium normally includes a form of stretch-wrap plastic film, which is chemically inert, impervious to most liquids and highly adherent to the material around which it is wrapped. This method has proven to be effective in protecting the goods from any outside environmental damage and in facilitating the simplified transportation of the palletized load by a fork-lift or other material handing vehicle. However, this method has proven to be expensive and undesirable for use with numerous types of goods.

By their nature, wooden pallets harbour moisture and other impurities within the wood fibres from which they are composed. As such, when they are enclosed in the same impervious envelope of plastic wrap in which the goods are wrapped, the goods are necessarily exposed to this foreign material and moisture. If the goods are such that they are susceptible to corrosion and other degradation due to moisture and impurities contained in the wood, the protective effect of the wrapping layer is necessarily compromised. Thus, for goods comprising metallic materials in particular, such conventional methods of wrapping transport have proven unsuitable. In addition, the additional weight and cost of the pallet serves to add additional expense to the shipping process. Likewise, whether disposed of or stored for later use, pallets are expensive and bulky. Thus, even after the shipping process is complete, the pallet continues to add further expense to the shipping and handling process.

It is thus desirable to eliminate the pallet entirely without sacrificing protection to the load and thereby minimize packaging cost without sacrificing quality. A need thus exists for an automated apparatus and method of wrapping loads of material in a protective layer that is resilient to potentially damaging environmental factors, low in cost and easily removed for disposal. A need also exists for an automated apparatus and method that allows such an envelope of wrapping medium to be formed in conjunction with a pallet or other suitable platform that is of minimal cost.

None of the known automated wrappers and palletizers in the prior art provide an adequate solution to the forgoing problems. The subject invention is thus directed toward a wrapping apparatus and method which addresses, among others, the above-discussed needs and provides an apparatus and method for wrapping a large solid, item or a plurality of large solid items, in an envelope of protective packaging and for forming and securing a platform of minimal cost thereto, that is suitable for the handling and storage of loads of material for extended periods of time.

SUMMARY OF THE INVENTION

In accordance with a preferred form of the present invention, there is provided an automated apparatus for wrapping or unitizing a load of material in a unitary envelope of wrapping medium and for affixing a plurality of supports to the bottom of the unitized load of material, as well as a method of using the apparatus. The combination of the plurality of supports and web of wrapping medium serve the same purpose and function as would a traditional pallet banded to the load of material. However, the present apparatus and method provide superior protection against exposure of the load to any of the impurities or moisture that the load may come into contact with, at a great savings in weight and cost over any of the existing automated or manual palletizing apparatus. Further, after shipping and handling is complete, the packaging materials utilized by the instant invention may be easily broken down and recycled with minimal effort by the user.

The apparatus disclosed herein includes a retractable support table designed to support the load of material that is to be wrapped. The retractable support table is comprised of a plurality of individual support stands. Each support stand is adapted to be hydraulically biased between a raised position and a lowered position, such that a gap is created between the bottom of the load of material and the support stand, when support stand is in the lowered position. A endless loop track is provided and includes a shuttle that is able to travel about the entire circumference of the endless track. The endless loop track is mounted on a movable support frame that is adapted to traverse along the entire length of the retractable support table, while encircling the load of material in the endless loop track. Thus, by using appropriate electrical and hydraulic controls to successively lower the support stands in the path of the endless loop track while the applicator traverses the load, the present design allows the applicator to be positioned at any angle relative to the load of material. When loaded with stretch wrap material, the applicator can thus wrap the entire surface of the load, in a variety of patterns along the length of the load.

The method of achieving the preferred wrapping configuration includes the steps of placing individual runner boards on the appropriate support stands, placing a load of material to be wrapped atop the support stands containing the runner boards and maneuvering the loop trolley in conjunction with selectively biasing the appropriate support stands so as to permit the endless loop track to encircle the entire length of the load in an envelope of wrapping medium. The method further includes the steps temporarily affixing each of the runner boards to the wrapped load of material, positioning the loop trolley adjacent to an individual runner board, lowering the support stand beneath that runner board, and securing the runner board to the unitized load by means of the stretch material and repeating this process for each of the individual runner boards. The process results in a unitized load of material, contained in a unitary envelope of wrapping medium, and a plurality of runner boards, serving together as a pallet, each individually secured to the unitized load in their own envelopes of wrapping medium.

Accordingly, the present invention provides solutions to the aforementioned problems associated with existing unitizing and palletizing devices. The reader will appreciate that these and other details, objects and advantages will become apparent as the following detailed description of the present preferred embodiments thereof proceeds.

BRIEF DESCRIPTION OF THE DRAWINGS

In the accompanying drawings, preferred embodiments of the present invention are shown, wherein like reference numerals are employed to designate like parts and wherein.

DETAILED DESCRIPTION OF THE DRAWINGS

Figure 1:
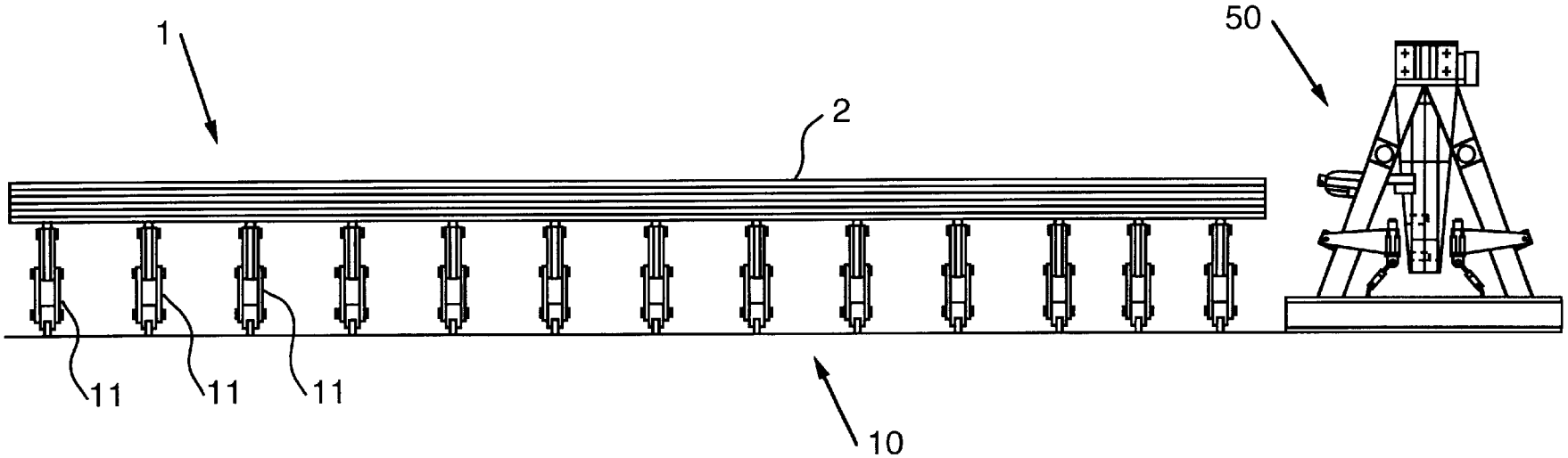
FIG. 1 is a side elevation view of an embodiment of the present invention showing a load of material positioned on the retractable support table with the loop trolley positioned adjacent to the load.

Referring now to the drawings for the purposes of illustrating the embodiments of the invention depicted in the Figures, and not for purposes of limiting the same, the Figures show a material wrapping apparatus. More particularly and with reference to FIG. 1, the wrapping apparatus is shown generally at 1 for a load 2 of elongated articles such as steel sheets.

Figure 2:
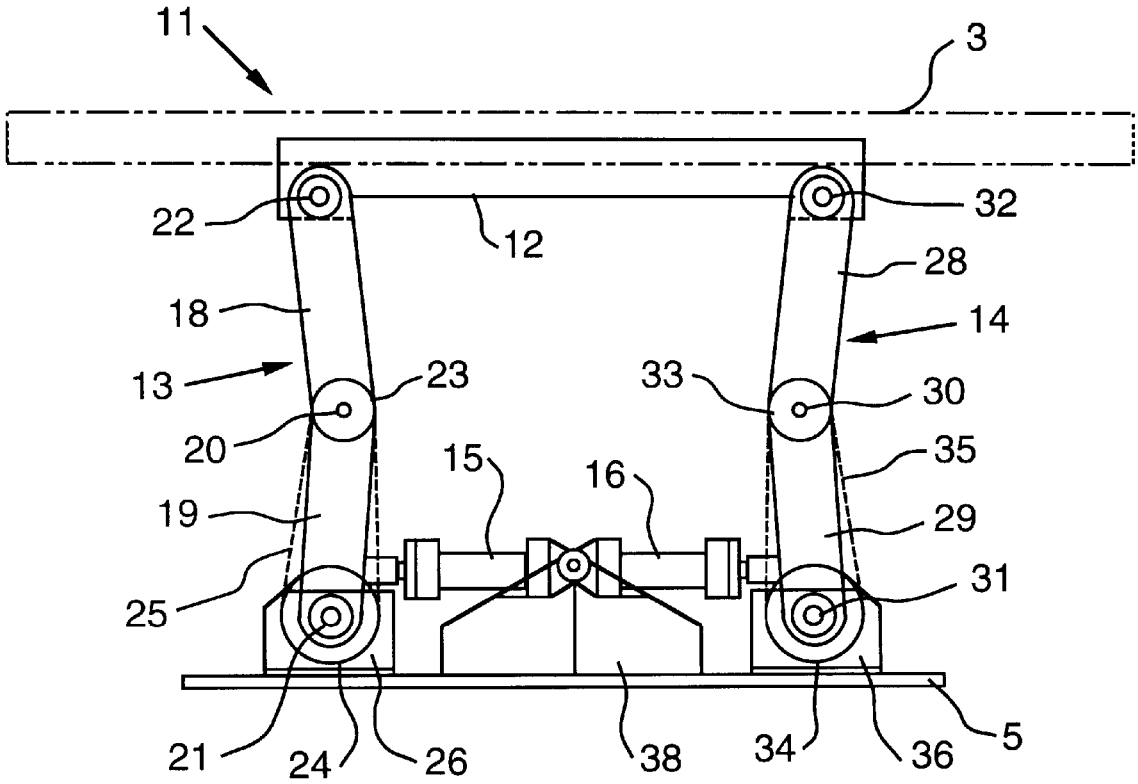
FIG. 2 is an end elevational view of the embodiment of FIG. 1 showing a single support stand with arms biased in the raised position, with a phantom image of a runner board positioned atop the support stand.
Figure 3:
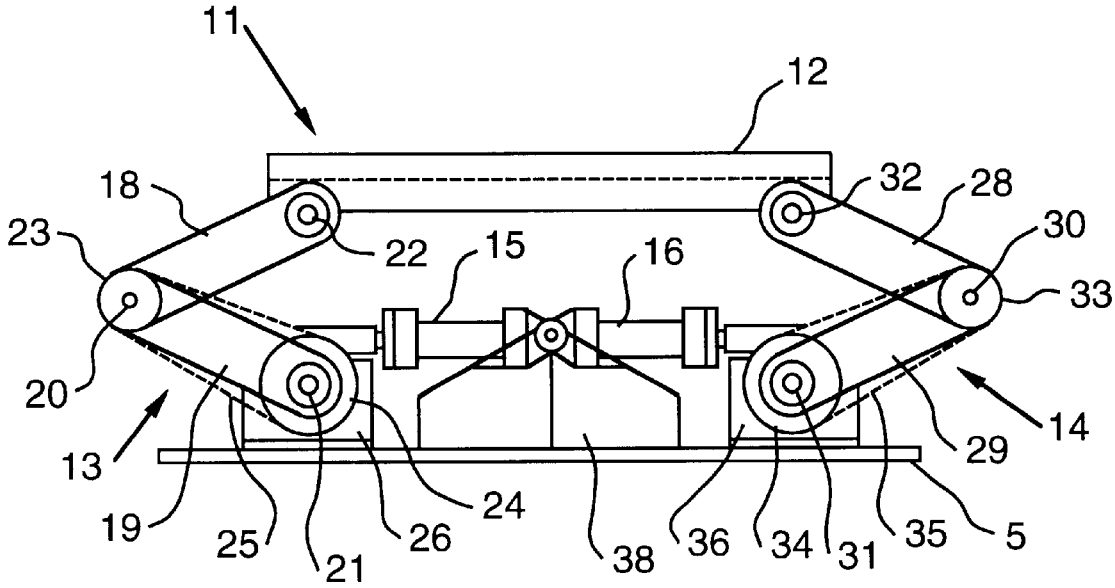
FIG. 3 is an end elevational view of the embodiment of FIG. 1 showing a single support stand with arms biased in the lowered position.

As shown in FIG. 1, the wrapping apparatus 1 includes a retractable support table 10 including a plurality of support stands 11 (shown with load of material 2 supported thereby) and a loop trolley 50 adapted to traverse along the length of the support table 10. As seen in FIGS. 2 and 3, each support stand 11 is preferably designed in an inverted scissors-lift design. As such, each support stand 11 generally includes first and second lift members 13 and 14 pivotally mounted to base portions 26 and 36, respectively, on floor plate 5 and first and second hydraulic cylinders 15 and 16, coupled between the first and second lift members 13 and 14, respectively, and base portion 38. First lift member 13 includes first and second arm portions 18 and 19, respectively, rotatably connected at a center joint 20. The first arm portion 18 is also rotatably connected at its other end to the load support bar 12. The second arm portion 19 is rotatably connected at its other end to base portion 26 by lower joint 21. Preferably, the upper, center and lower joints 22, 20 and 21, respectively, are comprised of shaft mounted roller bearings or the like. Likewise, the first and second arm portions 18 and 19 are preferably of equal length such that the distance between the center joint 20 and the upper joint 22 is equal to the distance between the center joint 20 and the lower joint 21. Second lift member 14 includes primary and secondary arm portions 28 and 29, respectively, rotatably connected at a center joint 30. The primary arm portion 28 is also rotatably connected at its other end to the load support bar 12, while the secondary arm portion 29 is rotatably connected at its other end to base portion 36 by lower joint 31. Preferably, the upper, center and lower joints 32, 30 and 31, respectively, are comprised of shaft mounted roller bearings or the like. Likewise, the primary and secondary arm portions 28 and 29 are preferably of equal length such that the distance between the center joint 30 and the upper joint 32 is equal to the distance between the center joint 30 and the lower joint 31. As shown in FIG. 2, the first and second arms 18 and 19 and the primary and secondary arms 28 and 29, respectively, are arranged to rotate over center about center joints 20 and 30, respectively, by a small degree to make the first and second lift members 13 and 14 self-locking in the raised position. Thus, as shown in the raised position in FIG. 2 and the lowered position in FIG. 3, the support stands are preferably implemented using an inverse scissors-lift design.

As shown in FIGS. 2–5, additional stability is provided to the inverted scissors-lift design of each lift member 11 by the addition of a chain and sprocket arrangement on each of the first and second lift members, respectively. In particular, as shown on the first lift member 13 in FIGS. 4 and 5, a lower sprocket 24 is attached to the first lift member 13 at lower joint 21. Rotation of the lower sprocket 24 is fixed relative to the base 26 by a keeper plate 40. An upper sprocket 23 is attached to the first lift member 13 at the center joint 20. Rotation of the upper sprocket 23 is fixed relative to the first arm 18 by an upper pin 41. A chain 25 is provided forming an endless loop around the upper and lower sprockets 23 and 24, respectively. Turnbuckles 39 are provided to tighten the chain and to thus maintain the span length of the chain 25 such that the distance of the portions of the chain 25 running between upper and lower sprockets 23 and 24, respectively, may be kept equidistant. As such, when the second arm 19 is pivoted, the upper sprocket 23 is forced to travel along the fixed chain 25, thus causing the first arm 18 to pivot in the opposite of the second arm 19 in a scissors-like motion. Preferably, the circumference of the upper sprocket 23 is half that of the lower sprocket 24. Due to the difference in circumference between the upper and lower sprockets 23 and 24, respectively, the first arm 18 is caused to pivot at twice the rate of second arm 19.

Figure 5:
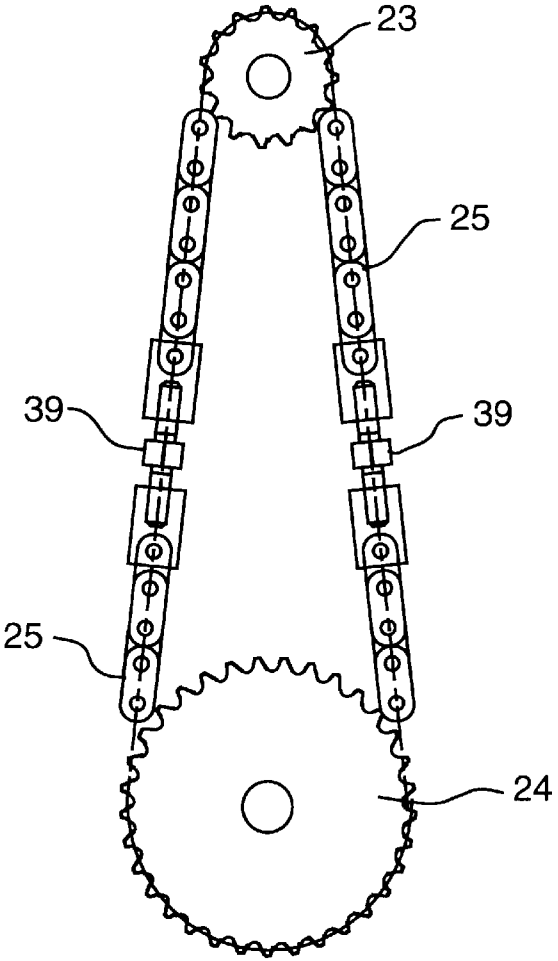
FIG. 5 is a side elevational view of chain and sprocket arrangement of the embodiment of FIG. 1.
Figure 4:
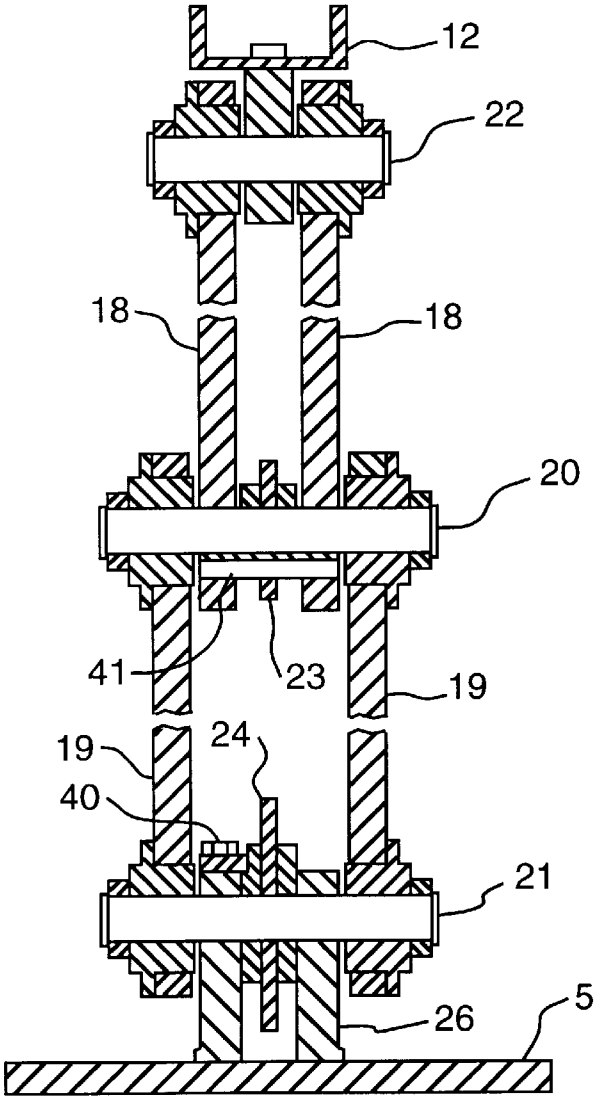
FIG. 4 is a sectional view of the first lift member of the embodiment of FIG. 1.

It will be appreciated that the operation and design of chain and sprocket arrangement on the first lift member 13, as depicted in FIGS. 4 and 5, is duplicated in second lift member 14. As such, in the second lift member 14, a lower sprocket 34 is attached to the second lift member 14 at lower joint 31. Rotation of the lower sprocket 34 is fixed relative to the base 36 by a keeper plate 40. An upper sprocket 33 is attached to the second lift member 14 at the center joint 30. Rotation of the upper sprocket 33 is fixed relative to the primary arm 28 by an upper pin 40. A chain 35 is provided to form an endless loop around the upper and lower sprockets 33 and 34, respectively. Turnbuckles 39 are provided to tighten the chain and thus maintain the span length of the chain 35 such that the distance of the portions of the chain 35 running between upper and lower sprockets 33 and 34, respectively, may be kept equidistant. As such, when the secondary arm 29 is pivoted, the upper sprocket 33 is forced to travel along the fixed chain 35, thus causing the primary arm 28 to pivot in the opposite direction of the secondary arm 29 in a scissors like motion. Preferably, the circumference of the upper sprocket 33 is approximately half that of the lower sprocket 34. Due to the difference in circumference between the upper and lower sprockets 33 and 34, respectively, the primary arm 28 to pivots at twice the rate of secondary arm 29.

It will be appreciated that such an inverted scissors-lift design described above also provides for automatic deceleration of the lift rate as the load bar 12 comes into contact with the bottom of the load 2. Likewise, it will also be appreciated that additional embodiments such telescoping members, accordion or multiple scissors lift members or a chain-lift apparatus could alternatively be employed to raise and lower the retractable support stands 11 and are within the purview of this disclosure.

As shown in FIGS. 2 and 3, hydraulic cylinders 15 and 16 are attached at one end to each of the first and second lift members 13 and 14, respectively, and at their opposite ends to an upright member 38 secured to floor plate 5. Preferably, the hydraulic cylinders 15 and 16 are attached to the second and secondary arms 19 and 29, respectively, of lift members 13 and 14, respectively, to provide for rapid biasing of the retractable stand between the raised position (see FIG. 2) and lowered position (see FIG. 3). The spacing between each individual retractable support stand 11 may be varied to facilitate wrapping of loads 2 having varying lengths as is desired by the user. In operation, each of the support stands 11 is able to be biased between a raised position (see FIG. 2) and a lowered position (see FIG. 3) by actuation of the hydraulic cylinders 15 and 16, respectively. The design and operation of the hydraulic cylinders is described in greater detail below.

Figure 6:
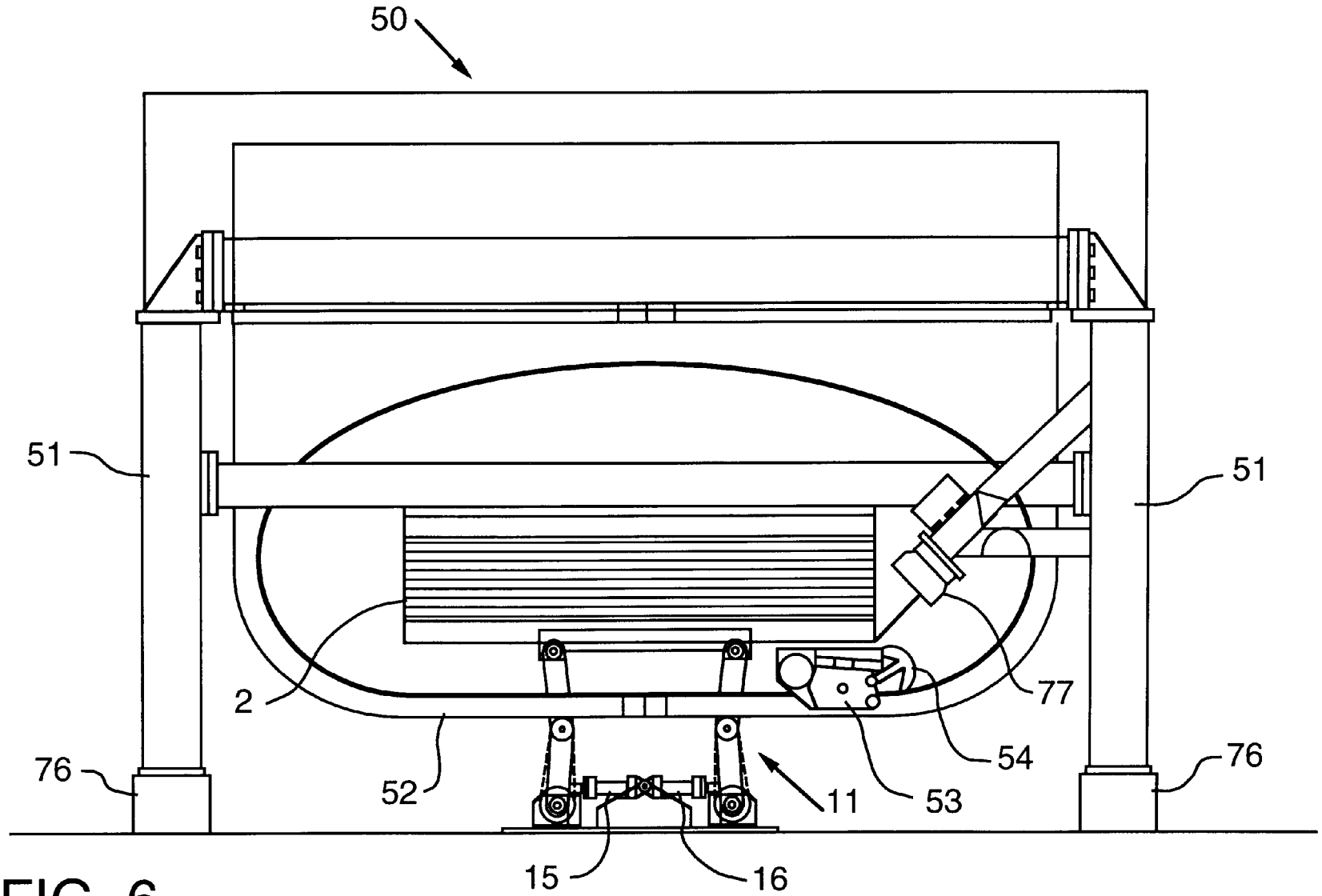
FIG. 6 is an end elevational view of the embodiment of FIG. 1 showing a load of material positioned on the retractable support table and the endless loop track encircling the load.
Figure 7:
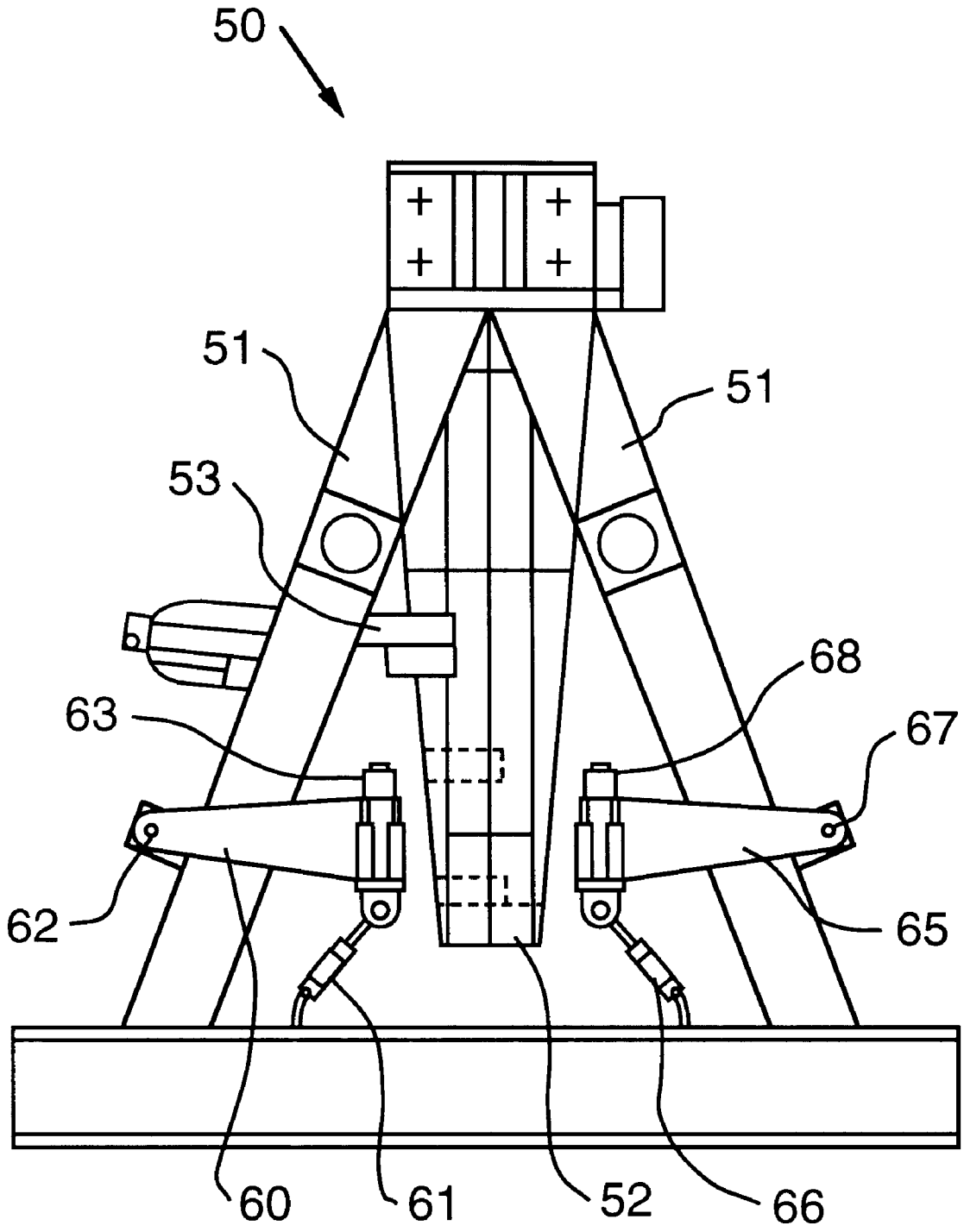
FIG. 7 is a side elevational view of the loop trolley of the embodiment of FIG. 1.
Figure 8:
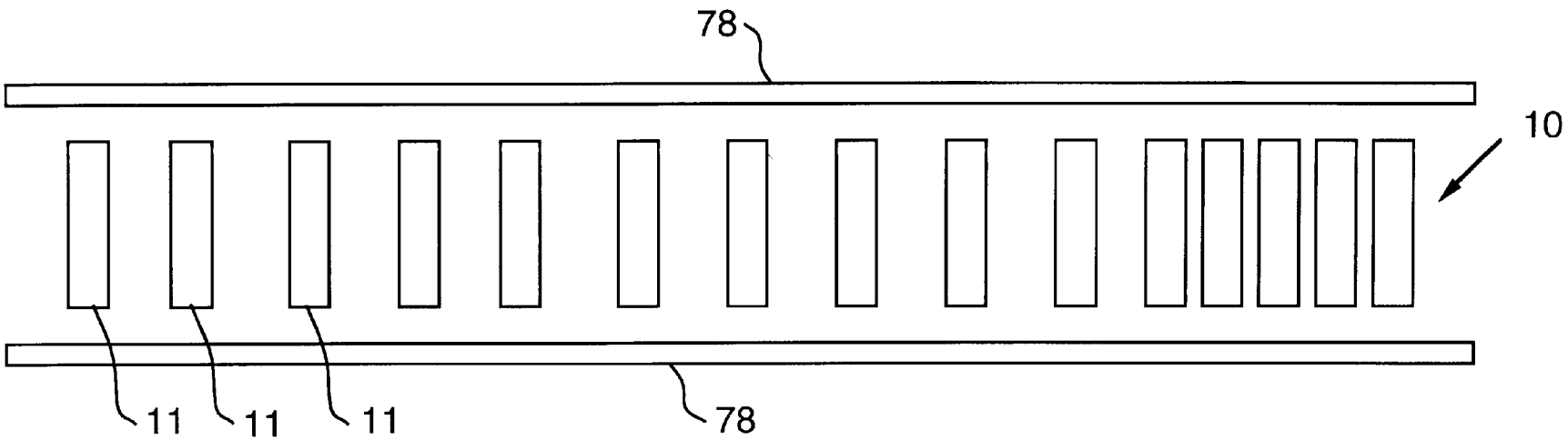
FIG. 8 is a top schematic view of the disappearing support table of the embodiment of FIG. 1.

In FIGS. 6 and 7, it can be seen that the loop trolley 50 includes a support frame 51 with an endless loop track 52 mounted thereto. The endless loop track 52 further includes a shuttle 53 and an applicator 54 mounted thereon. Preferably, the endless loop track 52 is a standard looped track, which may be such as that provided by Coilmaster USA of Addison, Ill., having a T-frame cross-section. Preferably, the shuttle 53, which also may be such as that provided by Coilmaster USA of Addison, Ill., is adapted to travel along the entire circumference of the T-frame endless loop track 52 on nylon wheels (not pictured) by means of a variable speed electric motor (not pictured) connected to a main drive axle by a timing belt (not pictured). A nylon pinion gear (not pictured) is mounted on the main drive axle of the shuttle 53 and is adapted to contact the inside of the T-frame endless loop track 52, thus enabling the shuttle 53 to travel about the entire circumference of the track 52. Preferably, the applicator 54, which also may be such as that provided by Coilmaster USA of Addison, Ill., is designed to dispense wrapping medium 80 and/or 81 onto the load 2. The wrapping medium 80 and/or 81 may include any one of the many forms of stretch-wrap plastic film currently available and is generally preferred to be chemically inert and impervious to most liquids. The loop trolley 50 itself is also outfitted with wheels 75 inside wheel housings 76, adapted to run along a set of tracks 78, placed in the floor 5, running along the sides of the retractable support table 10 (see FIG. 8), and variable speed electric motors (not pictured) that enable the trolley 50 to traverse along the length of the retractable support table 10. The loop trolley 50 is also provided with a cut and clamp assembly 77 designed to automatically clamp the wrapping medium 80 and/or 81 at the completion of a wrapping cycle and cut the material, thus allowing for the automatic starting of the next wrapping cycle. It will be appreciated that the foregoing equipment, which is described as preferably supplied by Coilmaster, USA could also be supplied by alternative sources as is required by the needs of the wrapping apparatus.

When any of the retractable stands 11 is in the lowered position (see FIG. 3), the portion of the load 2 normally supported by that stand 11 will have a natural tendency to deflect toward the floor 5 under the influence of gravity. Depending upon the stock and grade of the load 2, this deflection may be severe enough to interfere with the wrapping operation of the loop trolley 50. Lead and tail support arms 60 and 65, respectively, are provided to provide additional support to the load 2 and to prevent any deflection. The lead and tail support arms 60 and 65, respectively, are pivotably anchored to the support frame 51 at pivots 62 and 67, respectively. The movement of the lead and tail support arms 60 and 65, about pivots 62 and 67, respectively, is controlled by sets of hydraulic cylinders 61*a* and 61*b* and 66*a* and 66*b*, respectively. In operation, the lead support arm 60 may be raised by the action of a set of hydraulic cylinders 61*a* and 61*b* such that the support roll 63 contacts the bottom of the load 2 and prevents deflection of the load 2 from taking place. Similarly, the tail support arm 65 may be raised by the action of a set of hydraulic cylinders 66*a* and 66*b*, such that the support roll 68 too contacts the bottom of the load 2 and prevents deflection of the load 2 from taking place. It will be appreciated that the set of hydraulic cylinders 61*a* and 61*b* operates in unison, as does the set of hydraulic cylinders 66*a* and 66*b*. It will be further appreciated that both support arms 60 and 65, respectively, may be raised and lowered both alone or in tandem, thus providing for continuous support of the load 2 as the loop trolley 50 traverses past each support stand 11.

Figure 10:
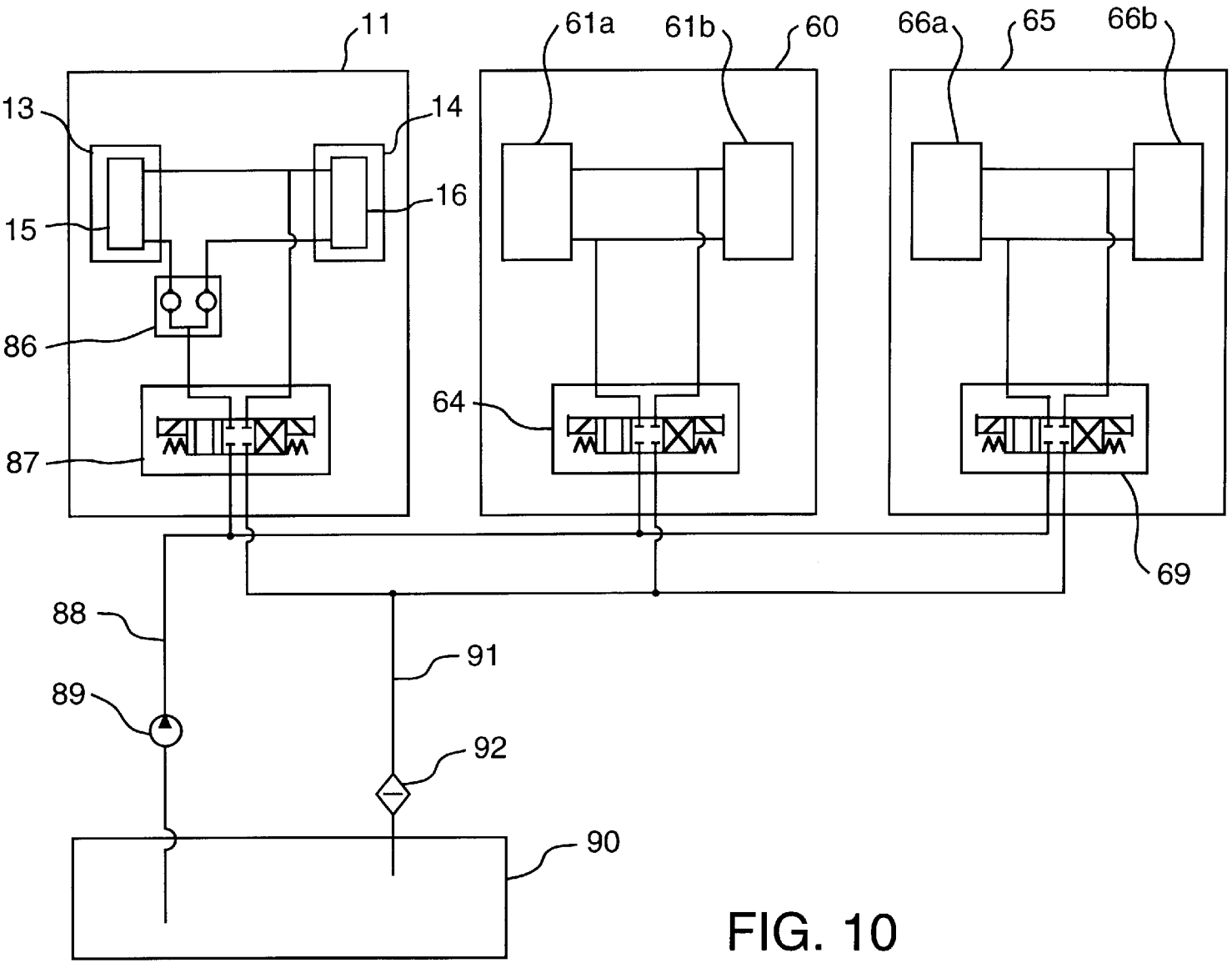
FIG. 10 is a schematic representation of the hydraulic control system of the embodiment of FIG. 1.

As shown schematically in FIG. 10, the first and second lift members 13 and 14 of the retractable support stands 11 are powered by hydraulic cylinders 15 and 16, respectively, and the support arms 60 and 65 are powered by hydraulic cylinders 61*a* and 61*b* and 66*a* and 66*b*, respectively. Preferably, the hydraulic system is powered by a single pump 89 feeding supply line 88 from hydraulic reservoir 90. As such, the hydraulic cylinders of the support stands 11, lead support arm 60, and tail support arm 65 are fed in series from this system. However, in the case of the retractable support stands 11, it is of primary importance that the hydraulic cylinders 15 and 16 raise and lower the first and second lift members 13 and 14, respectively, in unison such that the load support bar 12 remains parallel with the underside of the load 2 at all times. Thus, the hydraulic cylinders 15 and 16 of each support stand 11 are fed in parallel from the system. This parallel feed arrangement is preferably accomplished by providing a mechanical flow divider 86 in the supply line 88 to equally split the flow of hydraulic fluid from the supply line 88 that feeds the first and second lift members 13 and 14. As such, the flow of hydraulic fluid provided to each cylinder 15 and 16, respectively, by the supply line 88 will be equal. In addition, a double directional valve 87 is provided to regulate the flow of hydraulic fluid in and out of the cylinders 15 and 16. As such, equal flow is maintained within each of the cylinders 15 and 16 and the motion of the cylinders 15 and 16 is maintained in unison. In the case of the support arms 60 and 65, it is of primary importance that each of the support arms 60 and 65, be capable of independent movement. Thus, the sets of hydraulic cylinders 61*a* and 61*b* and 66*a* and 66*b*, serving the support arms 60 and 65, respectively, are linked in series to the hydraulic reservoir 90 by supply line 88. In addition, each of the sets of cylinders 61*a* and 61*b* and 66*a* and 66*b*, is also provided with a separate directional value 64 and 69, respectively, to independently regulate the flow of hydraulic fluid in and out of the cylinders.

Figure 11:
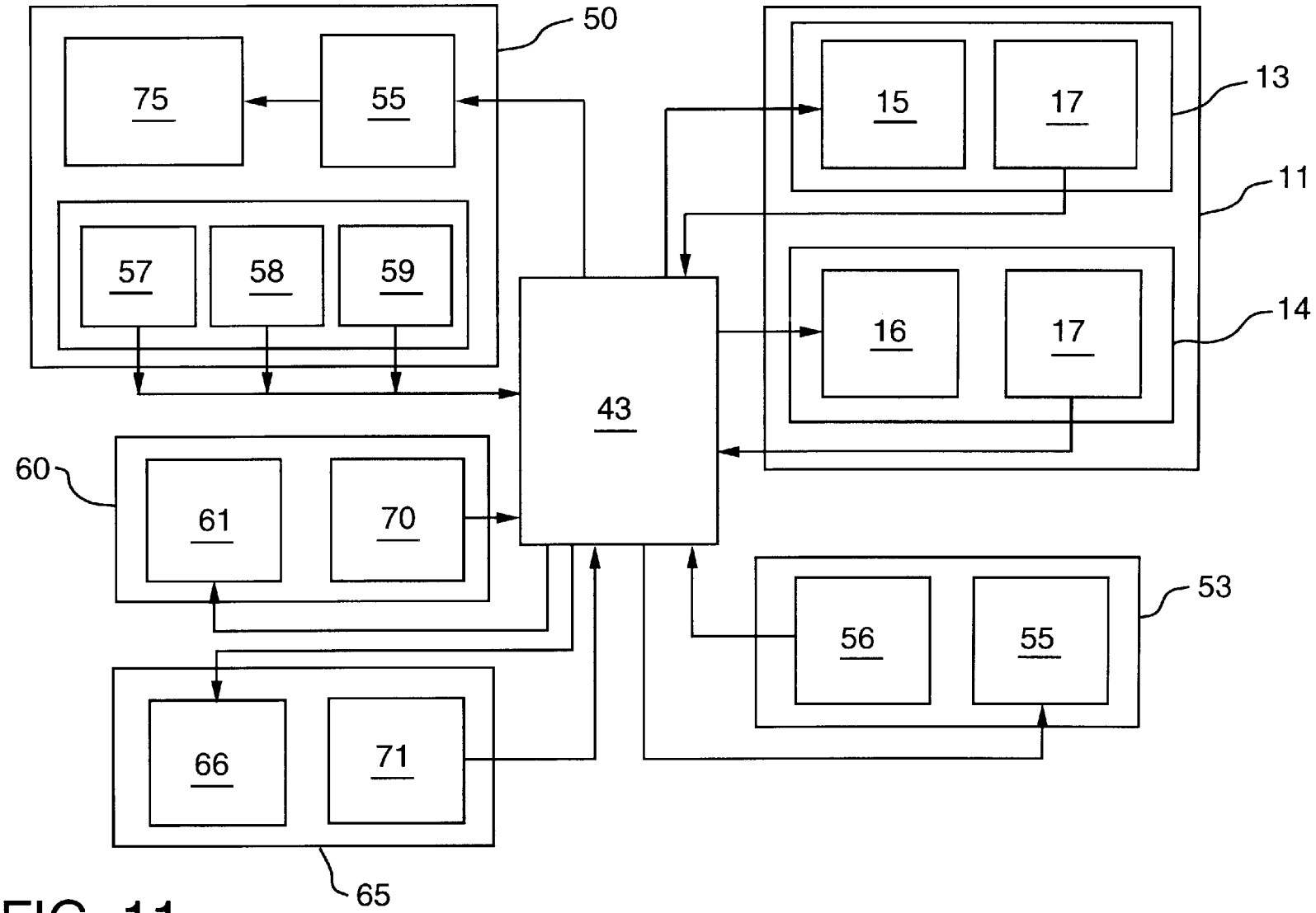
FIG. 11 is a schematic representation of the electrical control system of the embodiment of FIG. 1.

As shown schematically in FIG. 11, the automated operation of the electrical and hydraulic motors that power the wrapping apparatus 1 is controlled by a programmable computer 43. The data concerning the operation of the wrapping apparatus 1 is provided to the programmable computer 43 by a variety of data collection devices positioned on the wrapping apparatus 1. The position of the trolley 50 on the floor tracks 78 relative to the load 2 is preferably derived from several sources. Absolute real time distance measurements are provided by an optical distance measurement device 57 positioned on the support frame 51. Such a system is well known in the art and is used to determine the real time position of the trolley 50 on the floor tracks 78 relative to a fixed position at one end of the tracks 78. The position of the trolley 50 relative to the support table 10 is provided by a photo-eye 58 positioned at the lead end of the support frame 51. As such, the photo-eye system 58 is also well known in the art and is capable of detecting the presence or absence of the load 2. Such a system is thus used to detect when the trolley 50 reaches the ends of the load 2. The precise position of the trolley 50 relative to each individual support stand 11 is provided by a series of proximity switches 59 positioned adjacent to each of the plurality of support stands 11, respectively. As the trolley 50 passes a given support stand 11, the proximity switch 59 adjacent to that support stand 11 is activated. As such, the activation of a particular proximity switch 59 indicates that the trolley 50 has reached the support stand 11 to which that particular switch 59 is adjacent. In addition, multiple input/output lines are provided to enable the programmable computer 43 to regulate the control of each of the hydraulic and electric motors.

The position of the support arms 60 and 65, respectively, is determined by a set of proximity switches 70 and 71 accompanying each of the arms 60 and 65, respectively. When the lead support arm 60 is in the raised position, proximity switch 70 is activated, thus indicating that the arm 60 is raised. Similarly, when the lead support arm 60 is in the lowered position, the proximity switch 70 is deactivated, indicating that the arm 60 is in the lowered position. It will be appreciated that the state of the tail support arm 65 is determined by a similar procedure involving proximity switch 71. As such, the relative position, raised or lowered, of each of the support arms 60 and 65, can be determined by the state of the proximity switches 70 and 71, respectively.

The position of the shuttle 53 on the endless loop track 52 is also determined by a set of proximity switches 56 positioned along the length of the endless loop track 52. When the shuttle 53 is in a given area of the endless loop track 52, the proximity switch 56 in that area of the track is activated, thus indicating that the shuttle 53 is in that area of the track 52. As the shuttle 53 moves out of the area of the track 52 occupied by that particular proximity switch 56 and enters the area occupied by a different proximity switch 56, the switch 56 is deactivated and the subsequent switch 56 is activated. As such, the movement of the shuttle 53 about the track 52 can be determined by monitoring the state of the proximity switches 56.

Referring now to FIGS. 9*a*–9*f*, the preferred method of bare wrapping a load of material 2 within a protective web of wrapping medium 80 is as follows. The length and type of material of the load 2 is entered into the computer control system 43. Using a look-up table or similar means, the computer determines the number of retractable support stands 11 that will need to be raised so that the load 2 is fully supported by the raised support stands 11. The necessary stands 11 are then raised such that each support stand 11 that is raised has a portion of the load 2 positioned above it and the load 2 is overhanging the support stands 11 closest to the lead and tail ends 6 and 7, respectively, of the load 2.

Figure 9A:
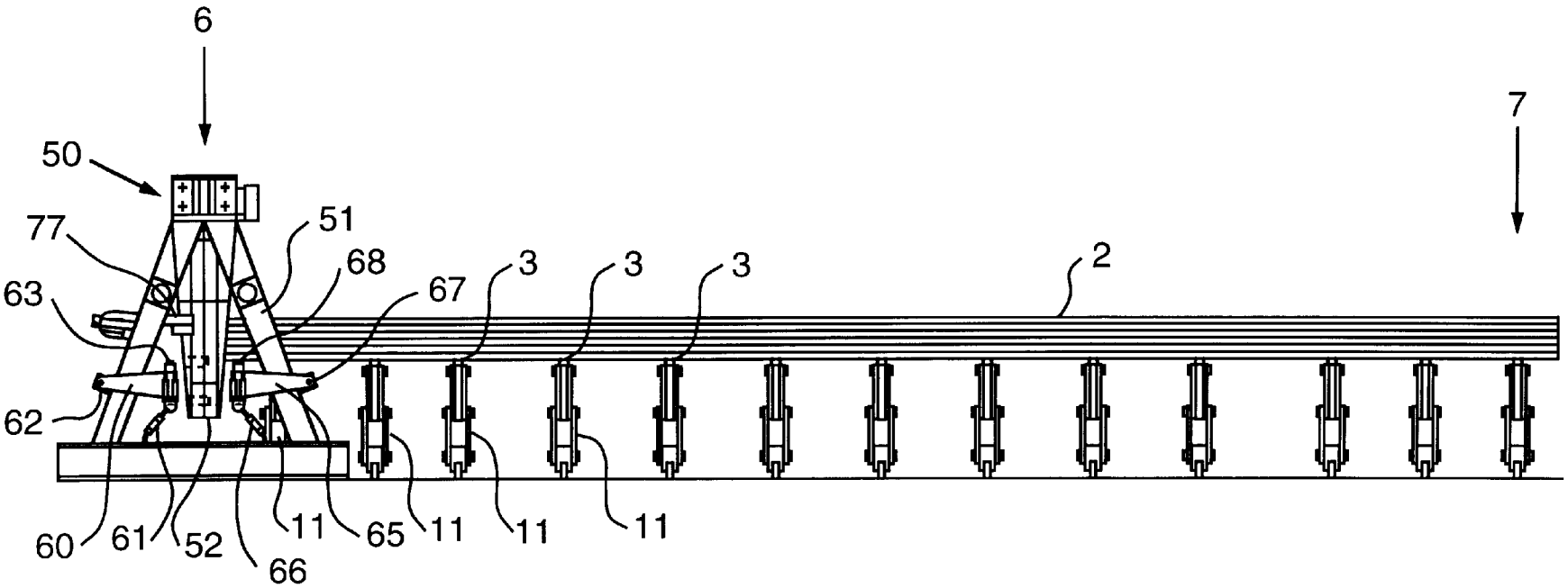
FIGS. 9*a* through 9*f* are side elevational views of the embodiment of FIG. 1 in six successive positions showing a load of material positioned on the retractable support table, with the endless loop track encircling the load and the loop trolley traversing along the length of the load as the support stands are successively biased into the lowered position.

As seen in FIG. 9*a*, once the required support stands 11 have been raised, a bare load 2 of material is placed atop the support table 10 formed by the raised support stands 11. The loop trolley 50 is traversed along tracks 78 relative to the retractable support table 10 so that the endless loop track 52 encircles the lead end 6 of the load 2. With the lead end 6 of the load 2 encircled by the circumference of the endless loop track 52, the shuttle 53 and applicator 54 are moved about the circumference of the endless loop track 52 while the applicator 54 dispenses a web of wrapping medium 80 onto the surface of the load 2. With the applicator 54 dispensing a web of wrapping medium 80 about the load, the loop trolley 50 is traversed along the length of the load 2 in the direction of the tail end 7. When the traversing trolley 50 approaches the retractable support stand 11 closest to the lead end 6 of the load 2 the lead support arm 60 is raised such that the support roll 63 contacts with the underside of the load 2. With the lead support arm 60 supporting the underside of the load 2, the support stand 11 closest to the lead end 6 of the load 2 is lowered so that the loop track 52 may pass between it and the underside of the load 2. As described above, the support frame 51 itself is adapted to pass to the outside of the retractable support 11. As the traversing loop trolley 50 passes the lowered stand 11, the tail support arm 65 is also raised such that the support roll 68 contacts and supports the underside of the load 2. As seen in FIGS. 9*c*–9*f*, as the loop trolley 50 is traversed further along the length of the load 2 in the direction of the tail end 7 of load 2 and the trolley 50 and endless loop track 52 pass clear of the lowered support stand 11, the lowered stand 11 is again raised and the next stand 11 in the path of the traversing trolley 50 is lowered. While this occurs, the support arms 60 and 65, respectively, remain raised to support the underside of the load 2. In such a way, no more than one of the retractable support stands 11 is in the lowered position at any one point in time.

As the trolley 50 continues to traverse toward the tail end 7 of the load 2, the support arms 60 and 65, respectively, remain in the raised position as each support stand 11 is successively raised and lowered as described above to allow the trolley 50 to pass. At the same time, the shuttle 53 and applicator 54 continue to travel about the endless loop track 52 and apply a web of wrapping medium 80 to the surface of load 2. When the trolley 50 reaches the tail end 7 of the load 2, the trolley 50 is reversed toward the lead end 6 of the load 2 until the tail support roll 68 is clear of the support stand 11 closest to the tail end 7. The trolley 50 is then stopped and the shuttle 53 is parked. Wrapping of the load 2 is now complete.

Preferably, the speed of the shuttle 53 and applicator 54 about the circumference of the endless loop track 52, relative to the speed of traverse of the trolley 50, is such that the entire surface of the load 2 is encased in wrapping medium 80. However, it can be appreciated by one skilled in the art, that by varying the rate of travel of the shuttle 53 and applicator 54 around the endless loop track 52 and the rate of traverse of the loop trolley 50 along the length of the load 3, that the pattern and thickness of the web of wrapping medium dispensed by the applicator 54 onto the material load 2 can be varied to the specifications required by the particular job.

Figure 9B:
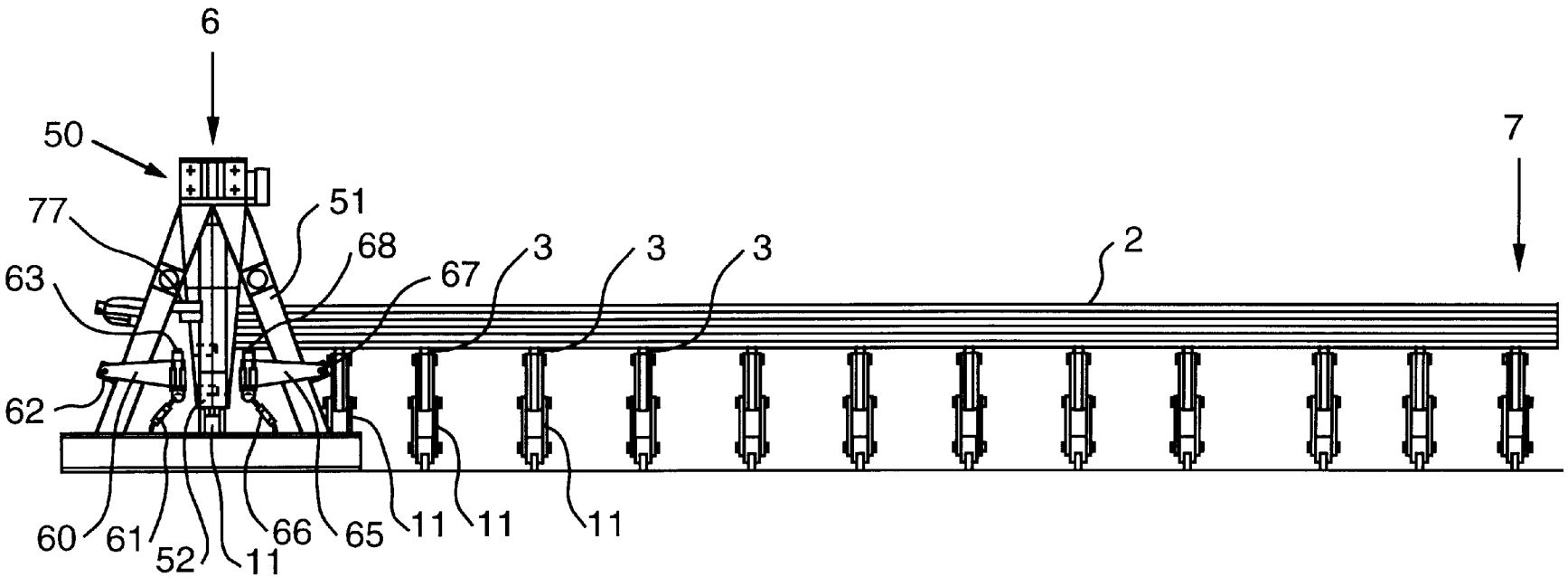
Figure 9C:
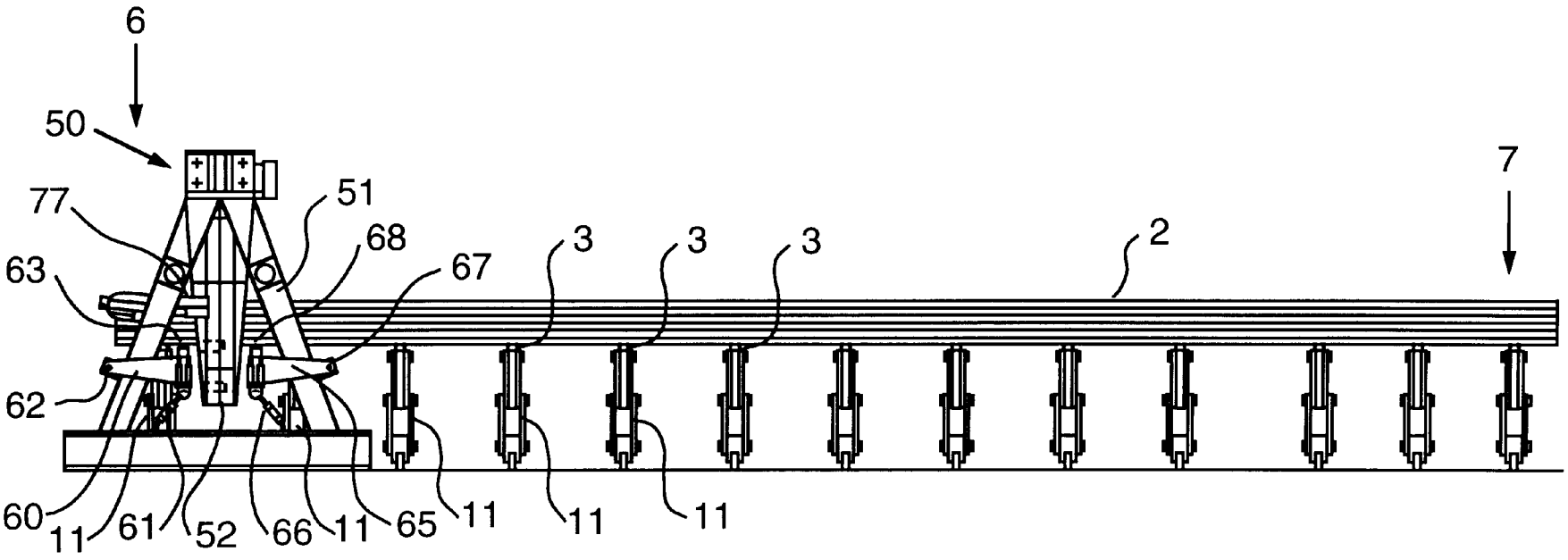
Figure 9D:
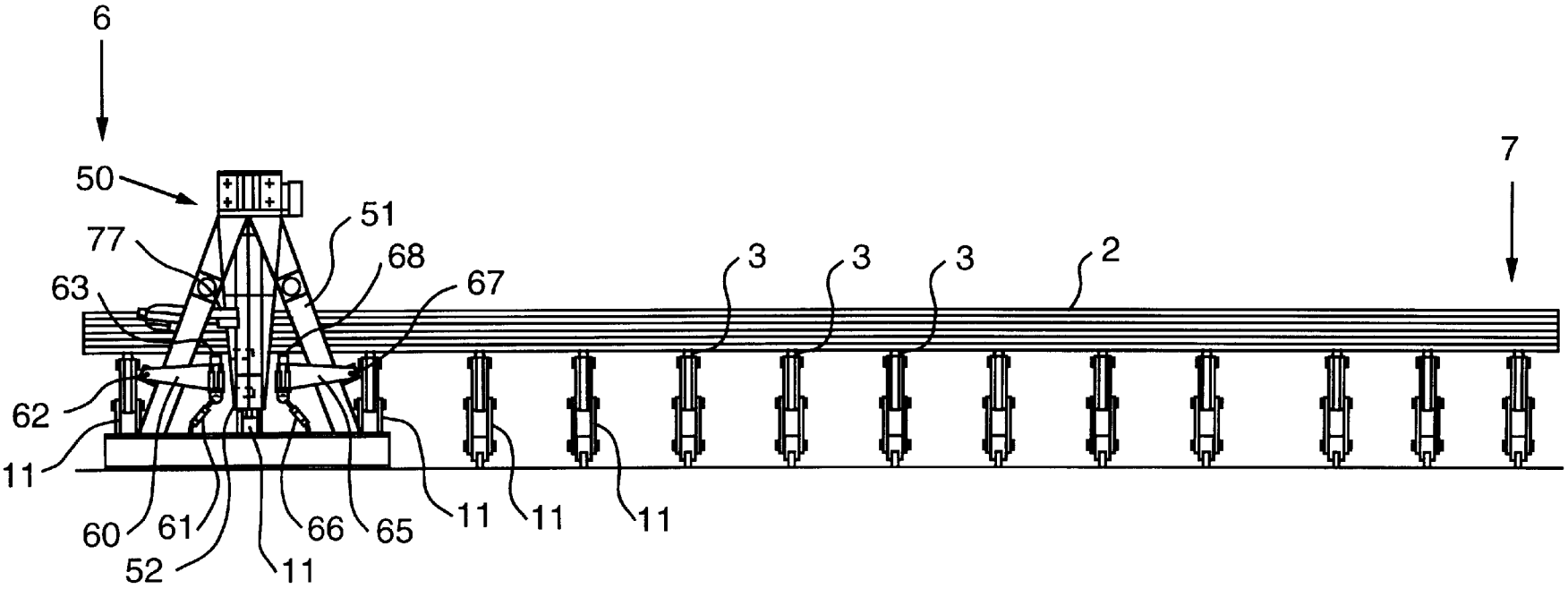
Figure 9E:
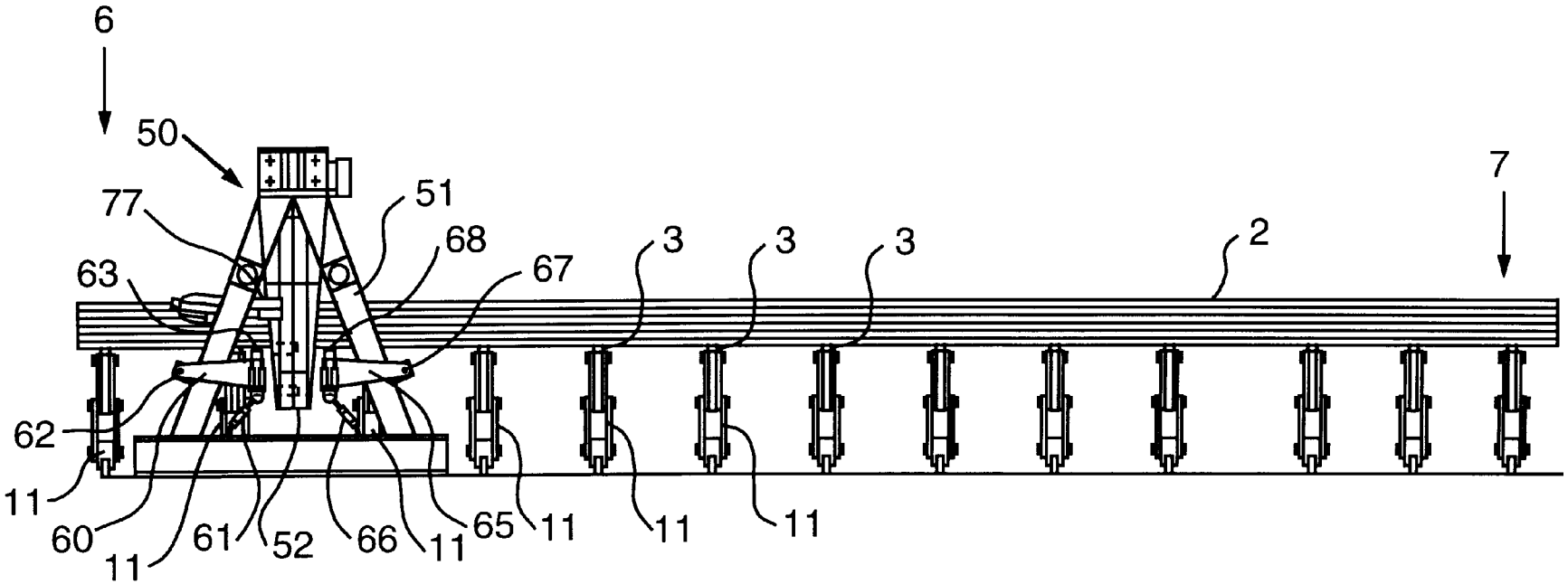
Figure 9F:
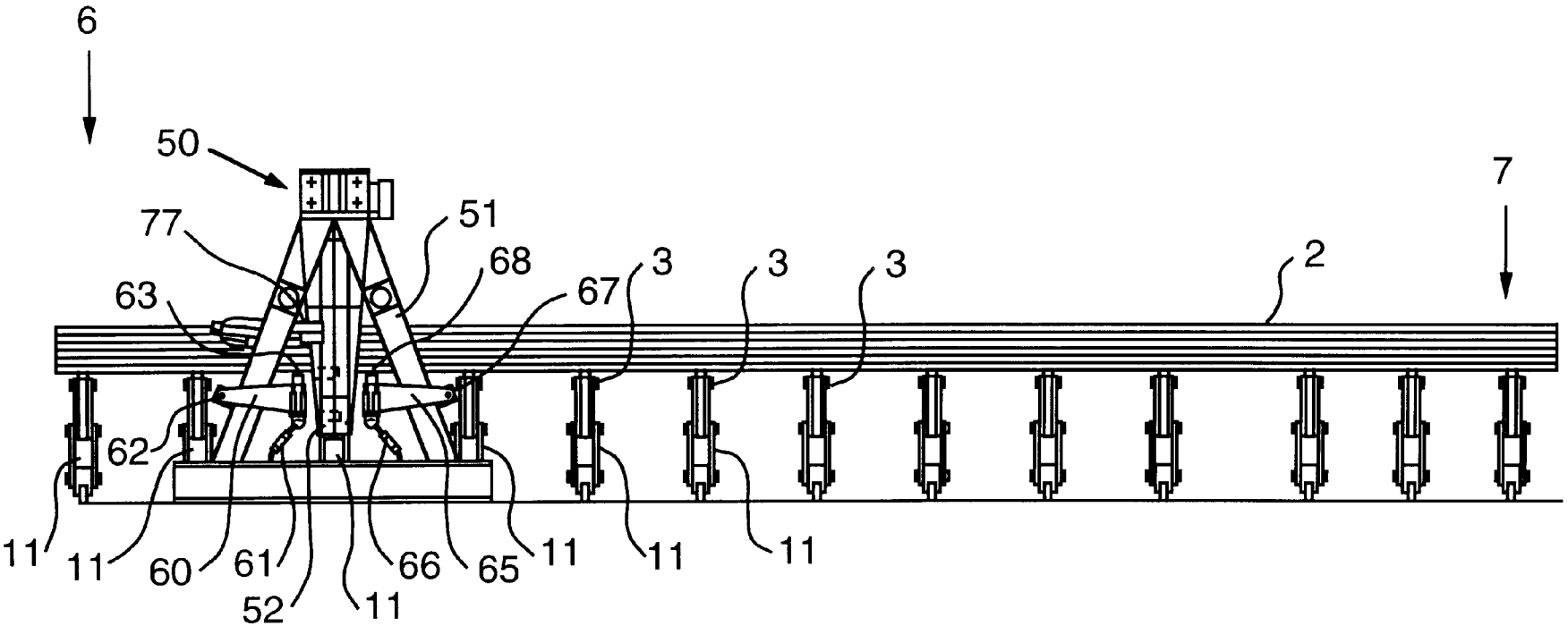

Referring again to FIGS. 9*a* through 9*f*, the preferred method of wrapping a load of material 2 within a protective web of wrapping medium 80 and of securing a plurality of runner boards 3 to the bottom of the load 2 is as follows. After the required number of retractable support stands 11 have been determined and raised to form the support table 10, using the method described above, a runner board 3 is loaded onto each of the raised support stands 11. As such, when the load 2 is placed atop the support table 10, each stand 11 that has a runner board 3 thereon will be beneath the load 2. A bare load of material 2 is then loaded onto runner boards 3 atop the support stands 11. As seen in FIG. 9*a*, with the shuttle 53 in a stationary position on loop track 52 and the support arms 60 and 65 in the lowered position, the loop trolley 50 traverses along floor tracks 78 toward the lead end 6 of the load 2. As seen in FIG. 9*a*, as the traversing trolley 50 passes the lead end 6 of the load 2, the lead support arm 60 is raised such that the support roll 63 contacts the underside of the load 2. As seen in FIG. 9*b*, as the traversing trolley 50 approaches the first support stand 11, the first support stand 11 will retract into the lowered position. When the trolley 50 has traversed far enough that the endless loop track 52 reaches the lead end 6 of the load 2, the trolley 50 pauses, the shuttle 53 and applicator 54 are activated and a predetermined number of revolutions of wrapping medium 80 are disposed about the surface of the load 2. It is preferred that this predetermined number of revolutions be three or more. As seen in FIG. 9*c*, the trolley 50 continues to traverse across the load 2 toward the tail end 7. When the tail support arm is beneath the load 2, it is raised such that the support roll 68 is in contact with the underside of the load 2. As the trolley continues to traverse, the applicator 54 continues to apply a web of wrapping medium 80 at a constant rate about the surface of the load 2. As the endless loop 52 and tail support arm 65 pass clear of the first support stand 11, the first support stand 11 is returned to the raised position and the next successive stand 11 is biased into the lowered position, thus clearing the way for the traversing trolley 50. As seen in FIG. 9*d*, the trolley 50 continues to traverse across the length of the load 2 toward the tail end 7. At the same time, the shuttle 53 and applicator 54 continue to travel about the endless loop track 52 and dispense a web of wrapping medium 80 onto the surface of the load 2. As seen in FIGS. 9*e* and 9*f*, as the trolley 50 and loop track 52 clear each successive stand 11, the stand is raised and the subsequent stand 11 is lowered, allowing the trolley 50 and loop track 52 to continue their traverse toward the tail end 7 of the load 2. Using such a method, of all the stands 11 positioned beneath the load 2, only a single stand 11 is in the lowered position at any one point in time. Upon reaching the tail end 7 of the load 2, the lead support arm 60 is lowered, the trolley 50 is reversed toward the lead end 6 of the load 2 until the tail support roll 68 is clear of the support stand 11 closest to the tail end 7. The trolley 50 is then stopped and the shuttle 53 is parked. The load 2 is completely encircled in a web of wrapping medium.

At this point in the process, the trolley 50 and applicator are paused while end seals (not pictured) and corner boards (not pictured) are manually applied to the ends 6 and 7, respectively, and edge protectors are placed on the load 2 to provide additional protection to the load 2 during transport. In addition, each of the runner boards 3, except the runner boards 3 closest to the lead and tail ends 6 and 7, respectively, is affixed to the wrapped load 2 using tape, nails, staples, adhesive or other suitably similar material.

The shuttle 53 and applicator 54 are then reactivated to apply a number of revolutions of wrapping medium 80 to the tail end 7 of the load 2, thus encasing the end seal (not pictured) at the tail end 7 of the load 2 in a web of wrapping medium 80. The trolley 50 is then traversed back toward the lead end 6 of the load 2. Note that the runner board 3 atop the stand 11 that is nearest to the tail end 7 of the load 2 is not secured to the load 2 and thus is lowered with the stand 11 when the trolley 50 traverses past the stand 11 and is not encircled in a web of wrapping medium 80. Once the lead support arm 60 clears the first support stand 11, the first support stand is raised, the lead support arm 60 is raised and the tail support arm 65 is lowered. The trolley 50 continues to traverse toward the lead end 6 of the load 2 until it reaches the support stand 11 that is second from the tail end 7 of the load 2. This support stand 11 is lowered and the trolley 50 traverses to position the loop track 52 and the support bar 12 in the same vertical plane. Note that since the runner board 3 that has been positioned atop this support stand 11 has been affixed to the wrapped load 2, the runner board 3 remains suspended beneath the wrapped load 2 when the stand 11 is lowered. Also note that since the slot 4 in the runner board 3 runs directly down the middle of the board 3 and since the loop track 52 and load support bar 12 are positioned in the same vertical plane, the loop track 52 is also positioned in the same vertical plane as the slot 4 in the runner board 3. The applicator 54 next forces the web 80 of wrapping medium into a rope of wrapping medium 81. The shuttle 53 revolves about the endless loop track 52 while the applicator applies the rope of wrapping medium 81 about the top of the load 2 and into the slot 4 in the runner board 3 for a predetermined number of revolutions. It is preferred that the number of revolutions be at least three revolutions. The trolley 50 then proceeds to traverse toward the lead end 6 of the load 2. Once the previously lowered stand 11 has been cleared by the lead support arm 60, the stand 11 is raised, the lead support arm 60 is raised, the tail support arm 65 is lowered and the subsequent stand 11 in the path of the trolley 50 toward the lead end 6 of the load 2 is lowered. Again the trolley 50 stops its traverse so that the endless loop track 52 is positioned directly above the center of the lowered stand 11. As described above, the shuttle 53 and applicator 54 remain activated so as to rope the load 2 and runner board 3 in at least three revolutions of roped wrapping medium 81. This process is repeated for each support stand 11 and runner board 3 until the first support stand 11 adjacent to the lead end 6 of the load 2 is reached. When the first support stand 11 adjacent the lead end 6 of the load 2 is reached, the stand 11 is lowered, the lead support arm 60 is raised, the tail support arm 65 is lowered, the roped wrapping medium 81 is re-expanded to a web 80 of wrapping medium and the trolley 50 proceeds to traverse past the lowered stand 11 toward the lead end of the pack. Note that, as with the runner board at the tail end 7 of the load 2, this runner board 3 has not been secured to the load 2. Thus the board 3 lowers when the support stand 11 and is not wrapped as the trolley 50 passes the lowered stand 11. When the lead end 6 of the load 2 is reached, the shuttle 53 and applicator 54 continue to apply a predetermined number of revolutions of wrapping medium 80 to the load 2, thus encasing the end seal (not pictured) in a web of wrapping medium 80. It is preferred that this predetermined number be at least three revolutions. The trolley 50 then traverses back toward the tail end 7 of the load 2 and the shuttle 53 and applicator 54 continue to apply a predetermined number of revolutions of wrapping medium 80 to the lead end of the load 2. It is preferred that this predetermined number be at least three revolutions. Note that the runner boards 3 that sit atop the support stands 2 that are immediately adjacent to the lead 6 and tail 7 ends of the load 2 have not been roped into place during this process. The cutting device 77 then severs the wrapping medium 80 and the trolley 50 proceeds to the position at the lead end 6 of the load 2 shown in FIG. 9*a*. At this point in the process, the runner boards 3 that are resting atop the stands 11 that are immediately adjacent to the lead 6 and tail 7 ends of the load 2 are strapped to the load 2 using any number of commonly known strapping methods and the wrapped and roped load 2 is removed then removed from the support table 10 for storage or shipping.

It will be appreciated by those of ordinary skill in the art that certain situations may require that the configuration of the runner boards 3 and wrapping medium 80 be altered. For example, a plurality of runner boards 3 may be placed lengthwise beneath the load 2 and secured into place by a web of wrapping medium 80. In such case, if desired, the load 2 may be first wrapped in an envelope of wrapping medium 80 according to the method detailed above and then the lengthwise running runner boards 3 may be placed beneath the load 3 and secured into place by a second envelope of wrapping medium 80. However, those of ordinary skill in the art will, of course, appreciate that still other changes in the details, materials, and arrangements of parts and methods which have been herein described and illustrated in order to explain the nature of the invention may be made by those skilled in the art within the principle and scope of the invention as expressed in the appended claims.

We claim:

1. A wrapping apparatus for wrapping a load of material in a wrapping medium comprising:

a loop structure defining an endless track mounted for traversal along the length of the load;

a moveable support frame supporting said track;

a shuttle mounted on said track adapted to navigate about the entire length of said track;

an applicator mounted on said shuttle adapted to dispense a continuous web of wrapping medium about the load while said loop structure is traversing the length of the load; and a plurality of support stands comprising a support table for supporting the load, the support stands individually movable between a raised position and a lowered position to allow said loop structure to pass between at least one of the support stands and the load.

2. The wrapping apparatus of claim 1, wherein said support stands are individually moveable between a raised position in which said support stand is in contact with said load of material and a lowered position in which there is sufficient distance between said load and said support stand that said frame and loop structure may pass therebetween.

3. The wrapping apparatus of claim 2, wherein each support stand comprises a support stand actuator for biasing said support stand between its raised position and its lowered position.

4. The wrapping apparatus of claim 3, wherein each support stand actuator comprises a hydraulic cylinder.

5. The wrapping apparatus of claim 4, further comprising a controller for controlling the movement of said actuators.

6. The wrapping apparatus of claim 1, wherein each support stand further comprises:

a first lift member comprising:

a first arm and a second arm;

said first and second arms each having first and second ends; and said first and second arms are rotatably joined at their first ends by a rotational joint; and a second lift member comprising:

a primary arm and a secondary arm;

said primary and secondary arms each having first and second ends; and said primary and secondary arms are each rotatably joined at their first ends by a rotation joint.

7. The wrapping apparatus of claim 6, wherein said first and second lift members are aligned such that said first arm of said first lift member and said primary arm of said second lift member rotate in opposing directions and said second arm of said first lift member and said secondary arm of said second lift member rotate in opposing directions.

8. The wrapping apparatus of claim 6, wherein said second end of said second arm is rotatably mounted to a base and said second end of said first arm is rotatably mounted to a load bar for supporting said load.

9. The wrapping apparatus of claim 6, wherein said second end of said secondary arm is rotatably mounted to a base and said second end of said primary arm is rotatably mounted to a load bar for supporting said load.

10. The wrapping apparatus of claim 6, wherein the length of said first arm is equal to the length of said second arm and the length of said primary arm is equal to the length of said secondary arm.

11. The wrapping apparatus of claim 6, further comprising a lower sprocket fixed to said second end of said second arm, an upper sprocket fixed to said first arm, and an endless loop chain engaging said lower and upper sprockets.

12. The wrapping apparatus of claim 11, wherein the rotational movement of said lower sprocket is fixed relative to a base and the rotational movement of said upper sprocket is fixed relative to said first arm such that movement of said second arm causes travel of said upper sprocket along said endless loop chain.

13. The wrapping apparatus of claim 6, further comprising a lower sprocket fixed to said second end of said secondary arm, an upper sprocket fixed to said primary arm, and an endless loop chain engaging said lower and upper sprockets.

14. The wrapping apparatus of claim 13, wherein said rotational movement of said lower sprocket is fixed relative to a base and said rotational movement of said upper sprocket is fixed relative to said primary arm such that movement of said secondary arm causes travel of said upper sprocket along said endless loop chain.

15. The wrapping apparatus of claim 1, further comprising an optical distance measurement system for determining the position of the moveable frame relative to said support table.

16. The wrapping apparatus of claim 1, further comprising a lead photo-eye positioned on the moveable frame relative to the support table.

17. The wrapping apparatus of claim 1, further comprising a photo-eye positioned on the shuttle relative to said endless loop track.

18. The wrapping apparatus of claim 1, further comprising one or more proximity switches positioned on each of said support stands.

19. The wrapping apparatus of claim 1, further comprising a lead support arm pivotably connected to said support frame and moveable between a lowered position and a raised position by a support arm actuator.

20. The wrapping apparatus of claim 19 wherein said support arm actuator comprises a hydraulic cylinder.

21. The wrapping apparatus of claim 19 further comprising a proximity switch mounted on said lead support arm.

22. The wrapping apparatus of claim 1, further comprising a tail support arm pivotably connected to said support frame and moveable between a lowered position and a raised position by a support arm actuator.

23. The wrapping apparatus of claim 22 wherein said support arm actuator comprises a hydraulic cylinder.

24. The wrapping apparatus of claim 22 further comprising a proximity switch mounted on said tail support arm.

25. The wrapping apparatus of claim 1, further comprising a wrap slicing member adapted to slice said web of flexible wrapping medium.

26. The wrapping apparatus of claim 1, further comprising a set of tracks mounted along the length of said retractable support table wherein said moveable frame is provided with a plurality of wheels sized to ride on a set of tracks mounted on said floor.

27. A wrapping apparatus for wrapping a load of material comprising:

a loop structure defining an endless track mounted for traversal along the length of the load;

a moveable frame supporting said endless track;

a shuttle mounted on said track and able to navigate about the entire length of track while said loop structure is traversing the length of the load;

an applicator mounted on said shuttle adapted to dispense a web of flexible wrapping medium; and a plurality of retractable support stands aligned to form a retractable support table for supporting said load, said retractable support stands each being individually movable between a raised position in which the support stand is in contact with the load of material and a lowered position in which there is sufficient distance between the load and at least one support stand such that the frame and loop structure may pass therebetween.

28. A method of wrapping loads of material comprising the steps of:

placing a load of material upon a plurality of retractable support stands;

orienting an endless loop track to encircle the load of material to be wrapped;

lowering the height of the retractable support stand adjacent to the endless loop track so that the retractable support stand is no longer in contact with the load of material and so that the space between the retractable support stand and the load of material resting on the remainder of the retractable support stands is sufficient to allow the endless loop to pass therethrough;

while moving the endless loop track from one side of the lowered support stand to the opposite side, traversing a wrap applicator about the circumference of the endless loop track and dispensing wrapping medium therefrom onto the surface of the load of material; and returning the lowered support stand to the raised position once the endless loop track has passed from one side of the lowered support stand to the opposite side such that the support stand is again in contact with the load of material.

29. The method of wrapping and palletizing loads of material of claim 28, further comprising the steps of:

sequentially performing said lowering, moving, traversing, and returning steps with respect to each successive support stand.

30. A method of wrapping and palletizing loads of material comprising the steps of:

placing a runner member on each of a plurality of height adjustable support stands;

placing a load of material upon two or more of the plurality of height adjustable support stands;

orienting an endless loop track to encircle the load of material;

for each of a predetermined number of the height adjustable support stands:

lowering the height of the height adjustable support stand and runner member thereon adjacent to the endless loop track so that the height adjustable support stand is no longer in contact with the load of material and so that the space between the height adjustable support stand and the load of material resting on the remainder of the plurality of height adjustable support stands is sufficient to allow the endless loop to pass therebetween;

traversing a wrap applicator about the length of the endless loop track while dispensing wrapping medium therefrom about the surface of the load of material;

moving the endless loop track from one side of the lowered support stand to the opposite side; and returning the lowered support stand and the runner member thereon to the raised position such that it is again in contact with the load of material;

affixing the runner members to the wrapping medium on the surface of the load of material; and for each of a predetermined number of the height adjustable support stands:

lowering the height of the height adjustable support stand adjacent to the endless loop track so that the height adjustable support stand is no longer in contact with the runner member and so that the space between the height adjustable support stand and the runner member affixed to the wrapping medium on the surface of the load of material is sufficient to allow the endless loop to pass therethrough;

moving the endless loop track to encircle the runner member affixed to the load of material above the lowered height adjustable support stand;

forcing the web of wrapping medium into a rope;

traversing the wrap applicator about the length of the endless loop track while dispensing the rope of wrapping medium therefrom around the surface of the load of material and the surface of the runner member until the runner member has been secured to the load of material;

moving the endless loop track from one side of the lowered support stand to the opposite side; and returning the lowered support stand to the raised position so that it is again in contact with the load of material.

* * * * *